US008695388B2

(12) United States Patent
Miwa et al.

(10) Patent No.: US 8,695,388 B2
(45) Date of Patent: Apr. 15, 2014

(54) MECHANICAL KEY

(75) Inventors: Katsushi Miwa, Niwa-gun (JP); Takao Ogimoto, Niwa-gun (JP); Toshiharu Katagiri, Niwa-gun (JP)

(73) Assignee: Kabushiki Kaisha Tokai Denki Seisakusho, Aichi (JP)

( * ) Notice: Subject to any disclaimer, the term of this patent is extended or adjusted under 35 U.S.C. 154(b) by 649 days.

(21) Appl. No.: 11/419,001

(22) Filed: May 18, 2006

(65) Prior Publication Data

US 2006/0260370 A1 Nov. 23, 2006

(30) Foreign Application Priority Data

May 19, 2005 (JP) ..... 2005-147066

(51) Int. Cl.
*E05B 19/04* (2006.01)

(52) U.S. Cl.
USPC ..... 70/408; 70/395; 70/405; 70/456 R

(58) Field of Classification Search
USPC ..... 70/393, 395, 398, 402, 405, 456 R, 408
See application file for complete search history.

(56) References Cited

U.S. PATENT DOCUMENTS

| | | | | | |
|---|---|---|---|---|---|
| 3,349,589 | A | * | 10/1967 | Fricke | 70/408 |
| 3,408,842 | A | * | 11/1968 | Barnes et al. | 70/424 |
| 3,481,168 | A | * | 12/1969 | Unter | 70/408 |
| 3,841,120 | A | * | 10/1974 | Gartner | 70/395 |
| 3,895,508 | A | * | 7/1975 | Crasnianski | 70/395 |
| 3,950,973 | A | * | 4/1976 | Grasnianski | 70/408 |
| 4,312,200 | A | * | 1/1982 | Thomas | 70/408 |
| 4,888,970 | A | * | 12/1989 | Kinzler et al. | 70/408 |
| 4,901,548 | A | * | 2/1990 | Deslandes | 70/408 |
| 4,986,100 | A | * | 1/1991 | Terada | 70/395 |
| 5,099,665 | A | * | 3/1992 | Terada | 70/408 |
| 5,207,082 | A | * | 5/1993 | LeMaitre | 70/408 |
| 5,870,917 | A | * | 2/1999 | Mahot et al. | 70/408 |
| 6,041,629 | A | * | 3/2000 | Hughes | 70/394 |
| 6,138,486 | A | * | 10/2000 | Hughes | 70/394 |
| 6,196,036 | B1 | * | 3/2001 | Andersen | 70/408 |
| 6,637,245 | B1 | * | 10/2003 | Bolton | 70/408 |
| 6,651,470 | B1 | * | 11/2003 | Rafter | 70/395 |
| 6,691,539 | B2 | * | 2/2004 | Jacob et al. | 70/408 |
| 6,705,141 | B1 | * | 3/2004 | Jacob et al. | 70/408 |
| 6,817,217 | B2 | * | 11/2004 | McGuire et al. | 70/408 |

(Continued)

FOREIGN PATENT DOCUMENTS

| | | |
|---|---|---|
| CA | 997580 | 9/1976 |
| JP | 50-055498 | 5/1975 |
| JP | 11-135966 | 5/1999 |
| JP | 2003-260739 | 9/2003 |

*Primary Examiner* — Christopher Boswell
(74) *Attorney, Agent, or Firm* — Saul Ewing LLP

(57) ABSTRACT

A mechanical key for accommodation in a portable device for use in an electronic key system. The mechanical key is provided with a grip including a socket and a key plate fixed to the grip. The key plate includes a blade and a shank, which is inserted into the socket. The shank includes a first edge for abutting against the socket when the shank is inserted into the socket and a shoulder extending from the blade. The socket includes a guide for abutting against and guiding the first edge of the shank when the shank is inserted into the socket. The guide is mated with the first edge under pressure. The socket further includes a second edge for abutting against the shoulder when the shank is inserted into the socket. The second edge is mated with the shoulder under pressure.

8 Claims, 4 Drawing Sheets

(56) References Cited

U.S. PATENT DOCUMENTS 6,948,344 B2 * 9/2005 Janssen ..... 70/408
7,055,352 B2 * 6/2006 Meyerson et al. ..... 70/456 R
7,513,134 B2 * 4/2009 Hashimoto et al. ..... 70/456 R
2005/0217327 A1 * 10/2005 Frias Frias et al. ..... 70/395
2011/0016937 A1 * 1/2011 Downes ..... 70/393

* cited by examiner

MECHANICAL KEY

BACKGROUND OF THE INVENTION

The present invention relates to a mechanical key.

A mechanical key includes a grip and a key plate, which is inserted into the grip. Such a mechanical key may be used, for example, in an electronic key system for vehicles. An electronic key system includes a portable device, which is provided with a communication function, and a lock controller, which communicates with the portable device. The portable device is carried by a user, and the lock controller is installed in a vehicle.

When the user approaches the vehicle, the electronic key system establishes communication between the lock controller and the portable device, which is located outside the vehicle, to unlock a vehicle door. Since the electronic key system automatically unlocks the door, the user may enter the vehicle by just pulling the door knob.

The portable device incorporates a battery and uses the battery power to perform communication with the lock controller. Thus, when the voltage of the battery becomes less than a predetermined value, the portable device cannot communicate with the lock controller. As a result, the door cannot be unlocked with the electronic key system. To cope with such a case, the portable device includes a mechanical key to mechanically lock and unlock the door. This enables the user to unlock the door with the mechanical key even when communication between the portable device and the lock controller is disabled.

To improve portability, there is a demand for a more compact portable device. Thus, recent mechanical keys have become shorter. This has shortened the portion of the key plate that is inserted into the grip. As a result, when inserting the key plate into the grip, the key plate easily inclines relative to the grip, or the insertion direction. This makes it difficult to position the key plate relative to the grip, and the key plate may become loose.

SUMMARY OF THE INVENTION

The present invention provides a mechanical key enabling ensured positioning of a key plate relative to a grip.

One aspect of the present invention is a mechanical key provided with a grip including a socket. A key plate is fixed to the grip and has a thickness and a width. The key plate includes a blade and a shank, which is inserted into the socket in an insertion direction. The shank has a distal part. The socket of the grip includes a movement restriction portion for abutting against the shank of the key plate and restricting movement of the shank in a direction perpendicular to the insertion direction. The shank of the key plate includes a pivot restriction portion for restricting pivoting of the key plate about the distal part of the shank.

A further aspect of the present invention is a mechanical key for accommodation in a portable device for use in an electronic key system. The mechanical key is provided with a grip including a socket. A key plate is fixed to the grip and has a thickness and a width. The key plate includes a blade and a shank, which is inserted into the socket in an insertion direction. The shank of the key plate includes a first edge, extending in the insertion direction, for abutting against the socket when the shank is inserted into the socket. The shank also includes a shoulder extending from the blade. The socket includes a guide for abutting against and guiding the first edge of the shank when the shank is inserted into the socket. The guide is mated with the first edge under pressure so as to restrict movement of the key plate. The socket also includes a second edge for abutting against the shoulder when the shank is inserted into the socket. The second edge is mated with the shoulder under pressure so as to restrict movement of the key plate.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A preferred embodiment of the present invention will now be described with reference to the drawings. In the preferred embodiment, a portable device of an electronic key system includes a mechanical key 12.

Figure 1B:
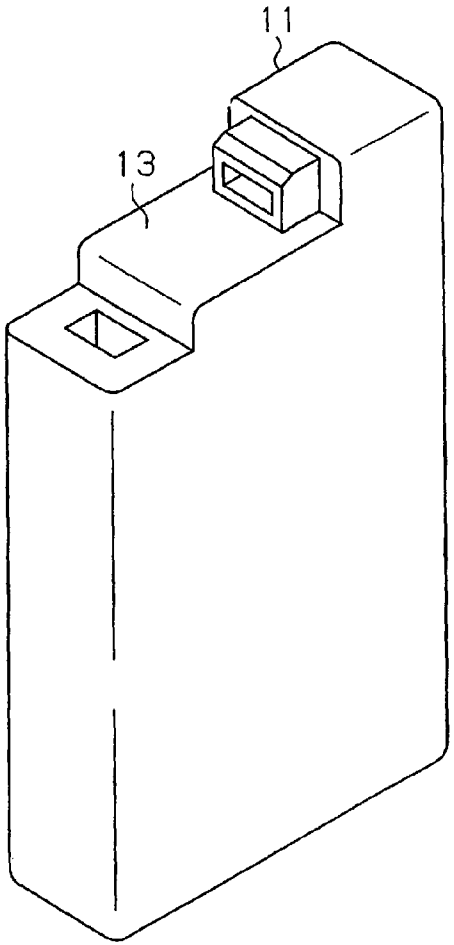
FIG. 1B is a perspective view showing a portable device that accommodates the mechanical key.
Figure 1A:
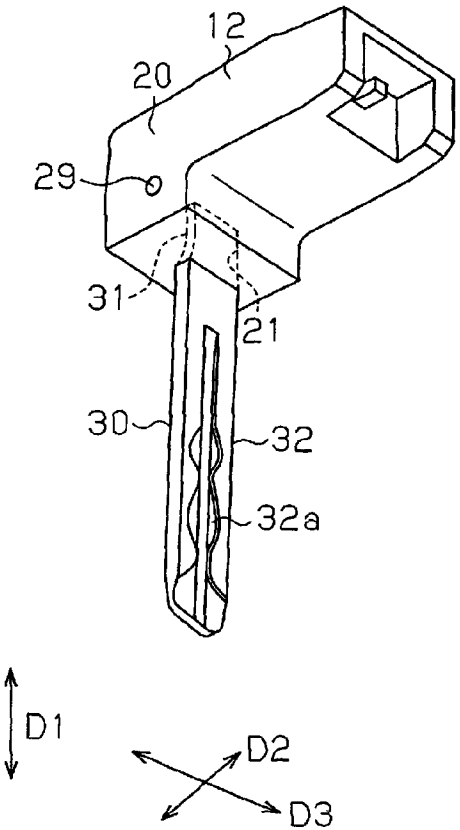
FIG. 1A is a perspective view showing a mechanical key.

Referring to FIGS. 1A and 1B, the portable device of the electronic key system includes a case 11. The mechanical key 12 is detachably attached to the case 11. The case 11 accommodates a transceiver, a transponder, and a battery (none are shown). The transceiver communicates with a lock controller (not shown), which is arranged in a vehicle. When a malfunction or battery drainage occurs in the portable device, the mechanical key 12 is used, for example, for insertion into a key cylinder (not shown) to perform locking or unlocking.

As shown in FIG. 1A, the mechanical key 12 includes a grip 20 and a key plate 30, which is fixed to the grip 20. The grip 20 and the key plate 30 are made of metal. The grip 20 includes a socket 21. A shank 31, which is inserted into the socket 21, is defined toward one end of the key plate 30, and a blade 32 is defined toward the other end of the key plate 30. The blade 32, which includes a serrated groove 32*a*, is inserted into a key cylinder. In the preferred embodiment, the longitudinal direction of the key plate 30, which is the direction the key plate 30 is inserted into the grip 20, is referred to as the insertion direction D1. The direction perpendicular to the plane of the key plate 30 shown in FIG. 1A is referred to as the thicknesswise direction D2. The direction extending laterally across the key plate 30 as viewed in FIG. 1A is referred to as the widthwise direction D3.

As shown in FIG. 1B, one corner of the case 11 is cut out to define a grip support 13 for receiving the mechanical key 12.

Referring to FIG. 1A, the grip 20 is formed so that the mechanical key 12 is L-shaped as a whole. The mechanical key 12 is detachable from the case 11. The mechanical key 12 is formed so that when it is attached to the case 11, the grip 20 is in correspondence with the grip support 13. The portable device has the shape of a generally thin box as a whole.

Figure 2A:
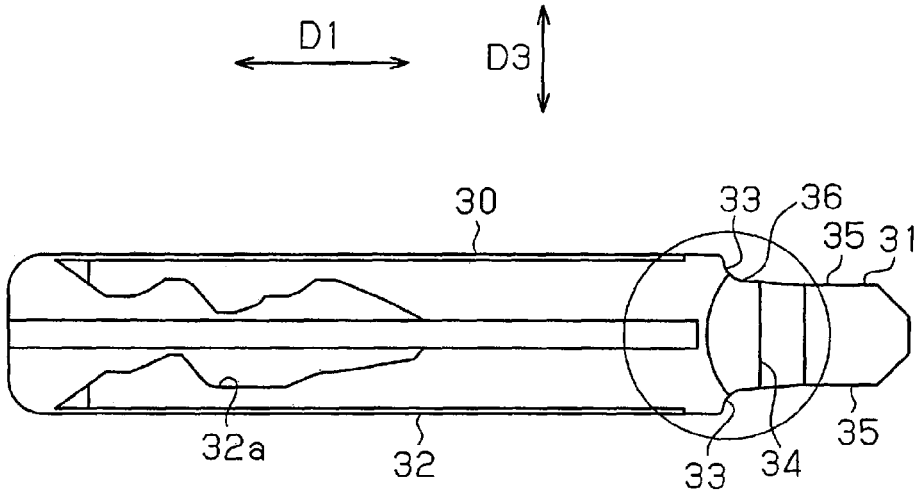
FIG. 2A is a plan view showing a key plate.

As shown in FIG. 2A, the blade 32, which includes the serrated groove 32*a*, extends toward one end of the key plate 30 in the insertion direction D1, and the shank 31, which is inserted into the socket 21 of the grip 20 (refer to FIG. 1A), extends toward the other end of the key plate 30 in the insertion direction D1. Compared to the blade 32, the shank 31 is reduced in size in the widthwise direction D3.

Figure 2B:
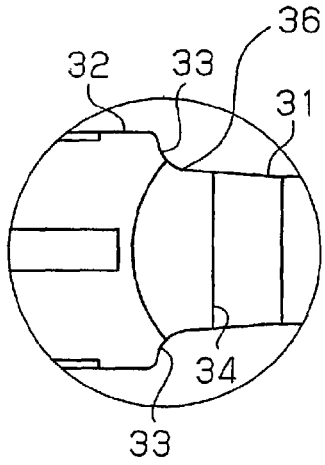
FIG. 2B is a partially enlarged view showing the key plate of FIG. 2A.
Figure 2C:
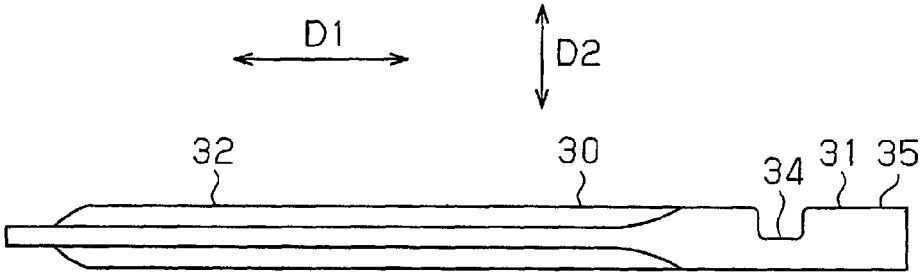
FIG. 2C is a side view showing the key plate.

As shown in FIG. 2B, a shoulder 36, which has inclined surfaces 33 opposed to each other, extends toward the blade 32 from the shank 31. The inclined surfaces 33 of the shoulder 36 are linear so that the dimension of the shoulder 36 in the thicknesswise direction D3 gradually increases toward the blade 32. The inclined surfaces 33 of the shoulder 36 function as a pivot restriction portion for restricting pivoting of the key plate 30 about the shank 31. Further, as shown in FIG. 2C, one side of the shank 31 includes a plate recess 34 located near the blade 32. The plate recess 34 extends in the widthwise direction D3. Guide abutment edges 35 are defined on the side of the shank 31 that includes the plate recess 34 (refer to FIGS. 4A and 4B).

Figure 3A:
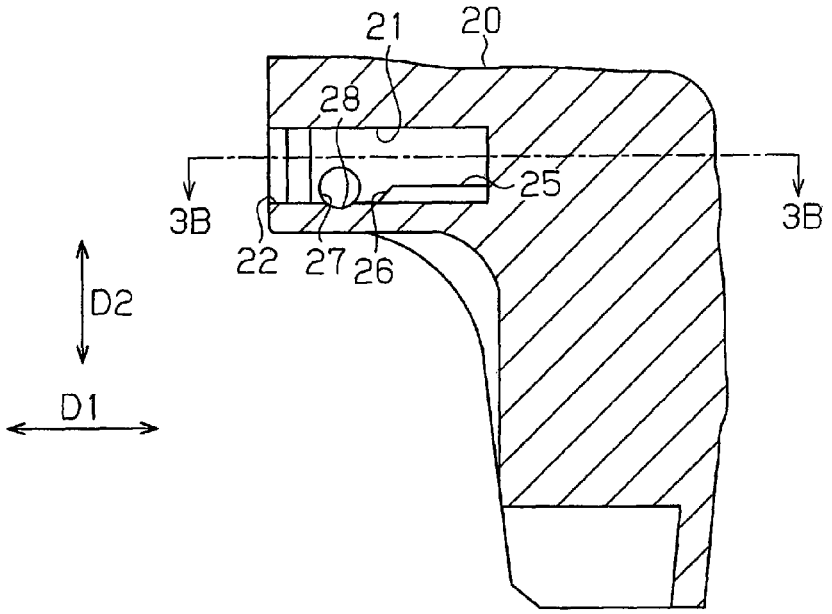
FIG. 3A is a cross-sectional view of a grip.
Figure 3B:
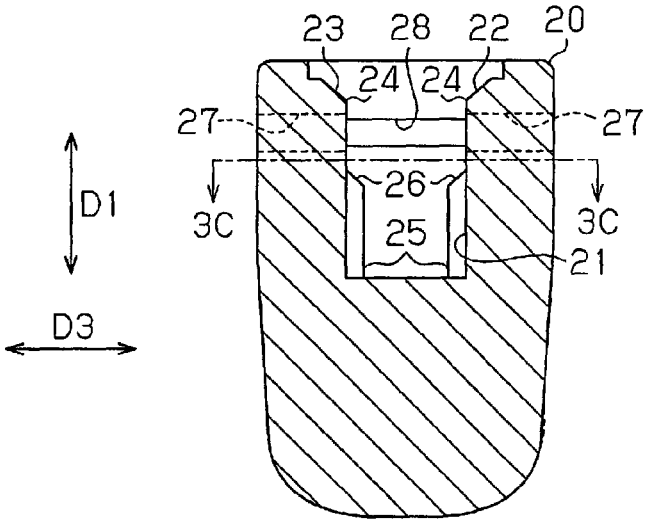
FIG. 3B is a cross-sectional view taken along line 3B-3B in FIG. 3A.

Referring to FIGS. 3A and 3B, the socket 21 of the grip 20 has an opening 22. In the opening 22, a shoulder seat 23 is formed so that the distance between the surfaces defining the shoulder seat 23 increases in the widthwise direction D3 toward the open end of the socket 21. The ends of the shoulder seat 23 farther from the open end of the socket 21 define shoulder abutment edges 24. The shoulder abutment edges 24 abut against the inclined surfaces 33 of the shoulder 36 in a manner that the shoulder abutment edges 24 are mated with the inclined surfaces 33 under pressure. That is, the inclined surfaces 33 of the shoulder 36 are press-fitted to the shoulder abutment edges 24 of the shoulder seat 23. The press-fitting absorbs dimensional errors of the key plate 30 in the widthwise direction D3.

The socket 21 includes guides 25. Each guide 25 is defined by a slanted surface linearly extending between the two walls of the socket 21 that face toward the corresponding guide abutment edge 35 in a state in which the shank 31 is inserted into the socket 21. The guides 25 guide the guide abutment edges 35 of the shank 31 during insertion of the key plate 30 into the socket 21. Further, the guides 25 abut against the guide abutment edges 35 in a manner that the guides 25 are mated with the guide abutment edges 35 under pressure. That is, the guide abutment edges 35 are press-fitted to the guides 25. The guides 25 function as a movement restriction portion for restricting movement of the key plate 30 in directions perpendicular to the insertion direction D1. In the preferred embodiment, the guides 25 restrict movement of the guides 25 in the thicknesswise direction D2 and the widthwise direction D3. Further, the press-fitting of the guide abutment edges 35 to the guides 25 absorbs errors in the cross-sectional dimensions of the key plate 30. That is, the press-fitting absorbs dimensional errors in the thicknesswise direction D2 and the widthwise direction D3.

Figure 3C:
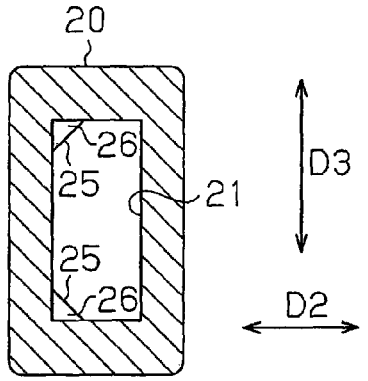
FIG. 3C is a cross-sectional view taken along line 3C-3C in FIG. 3B.

In detail, referring to FIGS. 3A and 3B, the guides 25 are each formed in the socket 21 to extend in the insertion direction D1 from the wall that comes into contact with the distal end of the key plate 30 to the middle part of the socket 21. Referring to FIG. 3C, the guides 25 are formed at corners located between the surface of the socket 21 extending in the widthwise direction D3 and facing toward the guide abutment edges 35 and each of the two surfaces extending from that surface in the thicknesswise direction D2. The guides 25 extends linearly at an angle of approximately 45° with respect to the thicknesswise direction D2 and the widthwise direction D3.

Figure 4A:
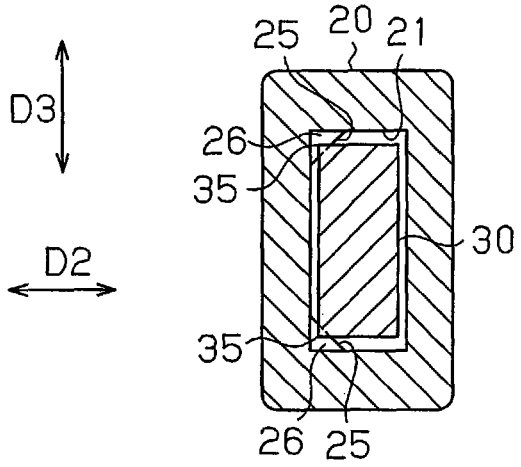
FIGS. 4A and 4B are cross-sectional views taken along line 3C-3C in FIG. 3B and showing the assembly of the mechanical key.
Figure 4B:
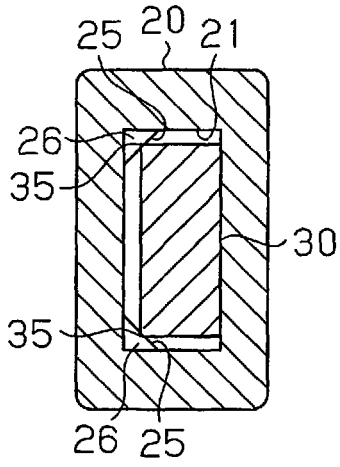

A tapered surface 26 extends diagonally toward the opening 22 from each guide 25. During insertion of the key plate 30 into the grip 20, when the distal part of the key plate 30 advances from a position free of the guides 25, as shown in the state of FIG. 4A, to a position having the guides 25, as shown in the state of FIG. 4B, the tapered surfaces 26 contact and guide the guide abutment edges 35 of the key plate 30. As the guide abutment edges 35 abut against the guides 25, the guides 25 press the key plate 30 against the wall of the socket 21 that is located on the opposite side of the guide abutment edges 35. This positions and fixes the key plate 30 in the socket 21.

As shown in FIG. 3B, holes 27 extends through the grip 20 in the widthwise direction D3. Further, a grip recess 28 is formed in the grip 20 extending in the widthwise direction D3. The holes 27 and the grip recess 28 are located between the shoulder seat 23 and the guides 25 in correspondence with the plate recess 34 of the key plate 30. In a state in which the shank 31 of the key plate 30 is inserted into the socket 21, a pin 29 (FIG. 1A) is inserted through the holes 27 and arranged between the plate recess 34 and the grip recess 28. The pin 29, which is inserted through the grip 20 and retained in the plate recess 34, prevents the key plate 30 from moving out of the socket 21 in the insertion direction D1 and holds the key plate 30 in the grip 20.

Figure 5:
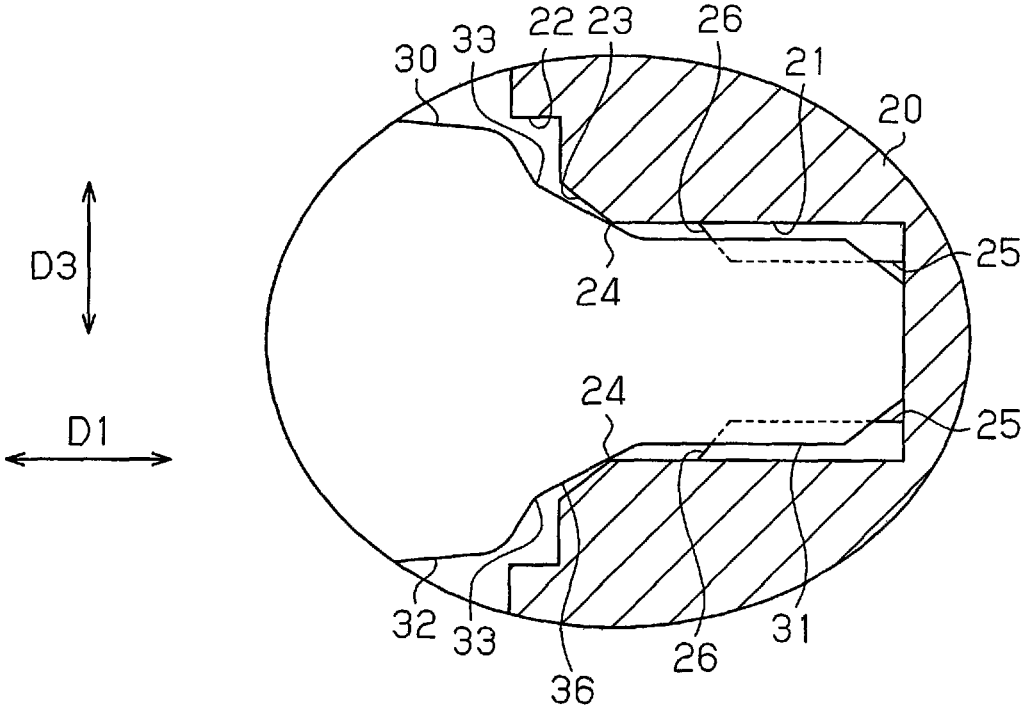
FIG. 5 is a schematic diagram showing the assembly of the mechanical key.

Referring to FIG. 5, in the mechanical key 12, the guides 25 of the grip 20 restrict movement of the distal part of the shank 31 that is inserted into the socket 21. Further, the inclined surfaces 33 of the shoulder 36 restrict pivoting of the key plate 30 about the distal part of the shank 31. Thus, movement of the shank 31 of the key plate 30 in the thicknesswise direction D2 and the widthwise direction is restricted.

The preferred embodiment has the advantages described below.

(1) When the shank 31 of the key plate 30 is inserted into the grip 20, the guides 25 of the grip 20 restrict movement of the key plate 30 in directions perpendicular to the insertion direction D1 (i.e., the thicknesswise direction D2 and the widthwise direction D3). Further, the inclined surfaces 33 of the key plate 30 restrict pivoting of the key plate 30 about the distal part of the shank 31. Thus, movement of the shank 31 of the key plate 30 when inserted into the grip 20 is restricted. This ensures positioning of key plate 30 in the socket 21 and prevents the key plate 30 from becoming loose.

(2) Movement of the key plate 30 in the thicknesswise direction D2 is restricted by the guides 25, and pivoting of the key plate 30 in the widthwise direction D3 is restricted by the inclined surfaces 33 of the shoulder 36. The guides 25 restrict movement of the shank 31. The inclined surfaces 33 restrict pivoting of the key plate 30 at positions located closer to the blade 32 than the distal part of the shank 31. Thus, movement of the key plate 30 in directions perpendicular to the insertion direction D1 is restricted at different locations in the insertion direction D1. This ensures positioning of the key plate 30 with respect to the grip 20.

(3) When inserting the key plate 30 into the grip 20, the guides 25 guide the guide abutment edges 35 of the shank 31 in the insertion direction D1 of the key plate 30. Thus, the key plate 30 is smoothly inserted into the socket 21. This facilitates assembly of the mechanical key 12. Further, the guide abutment edges 35 of the key plate 30 are mated with the guides 25 under pressure (press-fitted) in correspondence with the cross-sectional dimensions of the key plate 30. This absorbs errors in the cross-sectional dimensions (dimensions in the thicknesswise direction D2 and the widthwise direction D3) of the key plate 30.

(4) The abutment of the inclined surfaces 33 of the shank 31 against the shoulder abutment edges 24 of the grip 20 restrict pivoting of the key plate 30 about the distal part of the shank 31. Further, the shoulder abutment edges 24 of the grip 20 are mated with the inclined surfaces 33 under pressure (press-fitted) in correspondence with the dimensions of the key plate 30. This absorbs dimensional errors of the key plate 30 in the widthwise direction D3.

(5) The tapered surface 26 extends diagonally toward the opening 22 of the socket 21 from each guide 25. When the key plate 30 is inserted into the grip 20, each tapered surface 26 guides the distal part of the key plate 30. Thus, the key plate 30 is smoothly inserted into the socket 21.

(6) The shoulder abutment edges 24 of the grip 20 abut against the inclined surfaces 33 of the key plate 30, and the guide abutment edges 35 of the key plate 30 abut against the guides 25 of the grip 20. In this manner, the grip 20 and the key plate 30 contact each other at the abutment edges 24 and 35. Thus, the grip 20 and the key plate 30 are fixed to each other in an optimal manner even though they are made of metal, which is harder than resin.

It should be apparent to those skilled in the art that the present invention may be embodied in many other specific forms without departing from the spirit or scope of the invention. Particularly, it should be understood that the present invention may be embodied in the following forms.

In the preferred embodiment, the tapered surfaces 26 are formed extending from the guides 25 toward the opening 22. However, the tapered surfaces 26 are not necessarily required.

In the preferred embodiment, the guides 25 are arranged on opposite sides of the wall extending in the widthwise direction D3. However, the guides 25 may take other forms as long as movement of the key plate 30 in directions perpendicular to the insertion direction D1 of the shank 31 is restricted. For example, there may be only one guide 25. Alternatively, the guides 25 may be arranged on opposite sides of a wall extending in the thicknesswise direction D2.

In the preferred embodiment, the key plate 30 includes the inclined surfaces 33, which are linear such that the distance between the inclined surfaces 33 gradually increase in the widthwise direction D3 toward the blade 32. However, the inclined surfaces 33 may have other forms as long as pivoting of the key plate 30 about the distal part of the shank 31 is restricted.

In the preferred embodiment, the shoulder abutment edges 24 of the grip 20 that abut against the inclined surfaces 33 of the key plate 30 may take any form as long the shoulder abutment edges 24 abut against the inclined surfaces 33 and restrict pivoting of the key plate 30 about the distal part of the shank 31. However, it is preferable that the shoulder abutment edges 24 be located as far as possible from the distal part of the shank 31. This would space the shoulder abutment edges 24 from the pivoting center of the key plate 30 and position and fix the key plate 30 in the socket 21 in an optimal manner.

In the preferred embodiment, the grip 20 and the key plate 30 are made of metal. However, the grip 20 and the key plate 30 do not have to be made of metal and may be made of, for example, resin.

The present examples and embodiments are to be considered as illustrative and not restrictive, and the invention is not to be limited to the details given herein, but may be modified within the scope and equivalence of the appended claims.

What is claimed is:

1. A mechanical key comprising:

a grip including a socket;

a key plate fixed to the grip and having a thickness, a length, and a width, the key plate including a blade and a shank at opposite ends of the length, each having a width in a lateral direction perpendicular to the length, which is inserted into the socket in an insertion direction, with the shank having a distal part;

the socket of the grip including a movement restriction portion for abutting against the shank of the key plate and restricting movement of the shank relative to the grip in a direction perpendicular to the insertion direction; and the width in the lateral direction of the entire shank of the key plate being smaller than the width in the lateral direction of the entire blade, and the shank including a pivot restriction portion for restricting pivoting of the key plate about the distal part of the shank;

wherein the pivot restriction portion includes a shoulder having two opposed inclined surfaces extending continuously from the blade, with the distance between the inclined surfaces being increased toward the blade;

the socket includes an edge for each of the inclined surfaces of the shoulder, with the edge abutting against the corresponding one of the inclined surfaces of the shoulder when the shank is inserted into the socket so that the edge is mated with the shoulder under pressure to restrict pivoting of the key plate; and the movement restriction portion and the pivot restriction portion are spaced apart from each other in the insertion direction so as to restrict displacement of the key plate at different locations in the insertion direction in a state in which the shank is inserted into the socket, with the pivot restriction portion being located closer to the blade of the key plate than the movement restriction portion in such inserted state; and the shank includes a further edge, extending in the insertion direction, for abutting against the movement restriction portion when the shank is inserted into the socket; and the movement restriction portion includes a guide for abutting against and guiding the further edge of the shank when the shank is inserted into the socket, the guide being mated with the further edge under pressure so as to restrict movement of the key plate; and wherein the further edge is one of two abutment edges, the guide is one of two guides, and the two guides are mated with the corresponding abutment edges under pressure to restrict movement of the key plate relative to the socket.

2. The mechanical key according to claim 1, wherein: the movement restriction portion restricts movement of the key plate in the thicknesswise direction; and the pivot restriction portion restricts pivoting of the key plate in the widthwise direction.

3. The mechanical key according to claim 1, wherein: the movement restriction portion restricts movement of the key plate in the widthwise direction; and the pivot restriction portion restricts pivoting of the key plate in the widthwise direction.

4. The mechanical key according to claim 1, wherein the socket includes two walls facing toward the further edge, and the guide is defined by a slanted surface linearly extending between the two walls.

5. The mechanical key according to claim 1, wherein the socket includes:

a wall extending in the widthwise direction; and a tapered surface, extending diagonally between the wall and the guide, for guiding the further edge of the shank to the guide when the shank is inserted into the socket.

6. A mechanical key for accommodation in a portable device for use in an electronic key system, the mechanical key comprising:

a grip including a socket;

a key plate fixed to the grip and having a length, a thickness and a width, the key plate including a blade and a shank at opposite ends of the length, each having a width in a lateral direction perpendicular to the length, which is inserted into the socket in an insertion direction;

the width in the lateral direction of the entire shank of the key plate being smaller than the width in the lateral direction of the entire blade, the shank including:

a first edge, extending in the insertion direction, for abutting against the socket when the shank is inserted into the socket; and a shoulder including two opposed inclined surfaces extending continuously from the blade, with the distance between the inclined surfaces being increased toward the blade;

the socket including:

a guide for abutting against and guiding the first edge of the shank when the shank is inserted into the socket, the guide being mated with the first edge under pressure so as to restrict movement of the key plate relative to the grip; and a second edge for each of the inclined surfaces of the shoulder, with the second edge abutting against the corresponding one of the inclined surfaces of the shoulder when the shank is inserted into the socket, the second edge being mated with the shoulder under pressure so as to restrict movement of the key plate;

wherein the guide of the socket and the inclined surfaces of the shoulder are spaced apart from each other in the insertion direction so as to restrict displacement of the key plate at different locations in the insertion direction in a state in which the shank is inserted into the socket, with the inclined surfaces of the shoulder being located closer to the blade of the key plate than the guide of the socket in such inserted state; and wherein the first edge is one of two abutment edges, the guide is one of two guides, and the two guides are mated with the corresponding abutment edges under pressure to restrict movement of the key plate relative to the socket.

7. The mechanical key according to claim 6, wherein the socket includes two walls facing toward the first edge, and the guide is defined by a diagonal surface linearly extending between the two walls.

8. The mechanical key according to claim 6, wherein the socket includes:

a wall extending in the widthwise direction; and a tapered surface, extending diagonally between the wall and the guide, for guiding the first edge to the guide when the shank is inserted into the socket.

* * * * *

UNITED STATES PATENT AND TRADEMARK OFFICE

CERTIFICATE OF CORRECTION

PATENT NO. : 8,695,388 B2
APPLICATION NO. : 11/419001
DATED : April 15, 2014
INVENTOR(S) : Katsushi Miwa, Takao Ogimoto and Toshiharu Katagiri It is certified that error appears in the above-identified patent and that said Letters Patent is hereby corrected as shown below:

On the Title page, at item (73), Assignee name is:

KABUSHIKI KAISHA TOKAI RIKA DENKI SEISAKUSHO

Signed and Sealed this
Twenty-second Day of July, 2014

Michelle K. Lee

Michelle K. Lee
*Deputy Director of the United States Patent and Trademark Office*